US012233309B2

(12) United States Patent
Villency

(10) Patent No.: US 12,233,309 B2
(45) Date of Patent: Feb. 25, 2025

(54) ENERGY MAT

(71) Applicant: INDUSTRIAL DESIGN, LLC, New York, NY (US)

(72) Inventor: Eric Villency, New York, NY (US)

(73) Assignee: INDUSTRIAL DESIGN, LLC, New York, NY (US)

( * ) Notice: Subject to any disclaimer, the term of this patent is extended or adjusted under 35 U.S.C. 154(b) by 115 days.

(21) Appl. No.: 18/152,618

(22) Filed: Jan. 10, 2023

(65) Prior Publication Data

US 2023/0226403 A1 Jul. 20, 2023

Related U.S. Application Data

(60) Provisional application No. 63/299,680, filed on Jan. 14, 2022.

(51) Int. Cl.

| | |
|---|---|
| ***A63B 24/00*** | (2006.01) |
| ***A63B 21/00*** | (2006.01) |
| ***A63B 71/06*** | (2006.01) |

(52) U.S. Cl.

CPC ..... *A63B 21/4037* (2015.10); *A63B 71/0622* (2013.01); *A63B 2024/0093* (2013.01); *A63B 2071/0647* (2013.01); *A63B 2071/0658* (2013.01); *A63B 2209/08* (2013.01); *A63B 2210/50* (2013.01); *A63B 2220/808* (2013.01)

(58) Field of Classification Search

CPC ..... A63B 22/02–04

See application file for complete search history.

(56) References Cited

U.S. PATENT DOCUMENTS

| | | | | |
|---|---|---|---|---|
| 10,909,820 | B2 * | 2/2021 | Pillai | A61B 5/486 |
| 11,452,916 | B1 * | 9/2022 | Kahn | A63B 24/0075 |
| 2015/0251046 | A1 * | 9/2015 | Liu | A47G 9/06 5/420 |
| 2017/0177084 | A1 * | 6/2017 | Mangharam | A63B 21/4037 |
| 2017/0209742 | A1 * | 7/2017 | Merkel | A61B 5/6892 |
| 2017/0266533 | A1 * | 9/2017 | Dalebout | A63B 71/0622 |
| 2019/0099654 | A1 * | 4/2019 | Sobalvarro | A63B 21/4037 |
| 2021/0331036 | A1 * | 10/2021 | Gai | A63B 71/0622 |
| 2022/0008279 | A1 * | 1/2022 | Conrad | A61G 15/002 |
| 2022/0332982 | A1 * | 10/2022 | Ayscue | G09F 3/10 |
| 2022/0379162 | A1 * | 12/2022 | Way | A63B 21/4037 |
| 2023/0001261 | A1 * | 1/2023 | Kang | A63B 21/4037 |

(Continued)

FOREIGN PATENT DOCUMENTS

| | | | | |
|---|---|---|---|---|
| TW | 201509490 A * | 3/2015 | | A63B 21/4037 |
| WO | WO-2009042662 A2 * | 4/2009 | | A63B 21/4037 |

*Primary Examiner* — Nyca T Nguyen

(74) *Attorney, Agent, or Firm* — BAKERHOSTETLER

(57) ABSTRACT

Aspects of the present disclosure include an exercise mat including a first layer that includes a plurality of interstices. The exercise mat includes a second layer that includes a plurality of protrusions that extend from the top surface of the second layer, contain a display element, and correspond to the plurality of interstices. The top surface of the second layer is connected to the bottom surface of the first layer. The exercise mat includes a third layer including a cavity defined at least in part by a plurality of side surfaces, and an electronic component within the cavity. The top surface of the third layer is connected to the bottom surface of the second layer, and the electronic component is communicatively coupled to the display element.

20 Claims, 7 Drawing Sheets

(56) References Cited

U.S. PATENT DOCUMENTS

| | | | | |
|---|---|---|---|---|
| 2023/0241450 | A1* | 8/2023 | Sanghera | A63B 24/0062 482/4 |
| 2024/0054658 | A1* | 2/2024 | Immich | G06T 5/80 |

* cited by examiner

ENERGY MAT

CROSS-REFERENCE TO RELATED APPLICATIONS

This application claims priority to and the benefit of U.S. Provisional Application No. 63/299,680, entitled "ENERGY MAT," filed Jan. 14, 2022, which is incorporated by reference entirely herein.

TECHNICAL FIELD

The present description generally relates to exercise equipment and, more particularly, to exercise mats configured to include at least display functionality.

BACKGROUND

Smart devices generally refer to electronic devices that may be communicatively coupled (e.g., via Bluetooth) to other electronic devices. For example, a smartwatch generally refers to a watch that is communicatively coupled (e.g., via Bluetooth®) to a smartphone, which generally refers to a cell phone that is communicatively coupled to the Internet (e.g., via LTE wireless broadband).

Smart devices may include, for example, sensors for collecting biometric data while a user utilizing the smart watch is performing activities such as exercising. The biometric data may be sent from the smart device to another for processing and/or processed onboard the smart device. Integrated the hardware sufficient to turn a device into a smart device may cause the device to sacrifice some of its favorable qualities for its intended use. For example, integrating computing hardware into a mat may cause it to more rigid to protect the electronic components. However, there are a variety of activities that would benefit from the integration of smart devices into a mat to provide feedback, control, and/or guidance, but to date such integrations are not available.

BRIEF SUMMARY OF THE DISCLOSURE

The present disclosure includes an exercise mat including a first layer that includes a top surface and a bottom surface and a plurality of interstices. The exercise mat includes a second layer that includes a top surface and a bottom surface, and a plurality of protrusions extending from the top surface of the second layer, the plurality of protrusions contain a display element, and the plurality of protrusions correspond to the plurality of interstices such that, when the top surface of the second layer is connected to the bottom surface of the first layer, the plurality of protrusions are flush with the top surface of the first layer. The top surface of the second layer is connected to the bottom surface of the first layer. The exercise mat includes a third layer including a top surface, a bottom surface, a plurality of side surfaces, and a cavity defined at least in part by the plurality of side surfaces, and an electronic component within the cavity. The top surface of the third layer is connected to the bottom surface of the second layer, and the electronic component is communicatively coupled to the display element.

The present disclosure also includes an exercise mat including a first layer that includes a top surface and a bottom surface and a plurality of interstices. The exercise mat includes a second layer that includes a top surface and a bottom surface, and a plurality of protrusions extending from the top surface of the second layer, the plurality of protrusions contain a display element, and the plurality of protrusions corresponds to the plurality of interstices such that, when the top surface of the second layer is connected to the bottom surface of the first layer, the plurality of protrusions are flush with the top surface of the first layer. The top surface of the second layer is connected to the bottom surface of the first layer.

The present disclosure further includes an exercise mat including a first layer that includes a top surface and a bottom surface and a plurality of interstices. The exercise mat includes a second layer that includes a top surface and a bottom surface, and a plurality of protrusions extending from the top surface of the second layer, the plurality of protrusions contain a display element, and the plurality of protrusions corresponds to the plurality of interstices such that, when the top surface of the second layer is connected to the bottom surface of the first layer, the plurality of protrusions are flush with the top surface of the first layer. The top surface of the second layer is connected to the bottom surface of the first layer. The exercise mat includes a third layer including an electronic component that includes a processor and a memory storing machine-readable instructions. When executed by the processor, the machine-readable instructions cause the processor to perform operations including receiving a signal including a graphic and displaying the graphic via the second layer, wherein the plurality of protrusions present the graphic based on the signal.

The foregoing summary provides examples of certain aspects of the innovation, and should not be read to limit anything in the disclosure or claims of this or any related application.

BRIEF DESCRIPTION OF THE DRAWINGS

Certain features of the subject technology are set forth in the appended claims. However, for the purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, the subject technology is not limited to the specific details set forth herein and can be practiced using one or more other embodiments. In one or more embodiments, structures and components are shown in block diagram form in order to avoid obscuring the concepts of the subject technology.

Exercise mats provide a dedicated surface on which users exercise or perform other activities. They may protect floors, dampen noise, and provide grip and cushion for floor exercises, among other things. Exercise mats may appear in a variety of forms. One form may be a thin foam mat, which may be a portable mat that provides comfort for floor-based activities such as yoga and stretching. Adding "smart" features to such a mat can provide additional workout benefits, such as added motivation and workout guidance.

Some smart devices direct their "smart" features to particular activities. Smart devices have not been implemented with exercise mats. The subject technology aims to improve the usefulness of an add functionality to an exercise mat (e.g., a yoga mat). The exercise mat of the present disclosure provides the features of a traditional exercise mat while including "smart" features such as electronic displays, connectivity to external devices, exercise tracking, and the like. The integration of smart features does not interfere with the basic structure and use of an exercise mat, which still remains rollable/foldable, flexible, comfortable, water resistant or water proof, clean-able, and rugged.

Figure 1A:
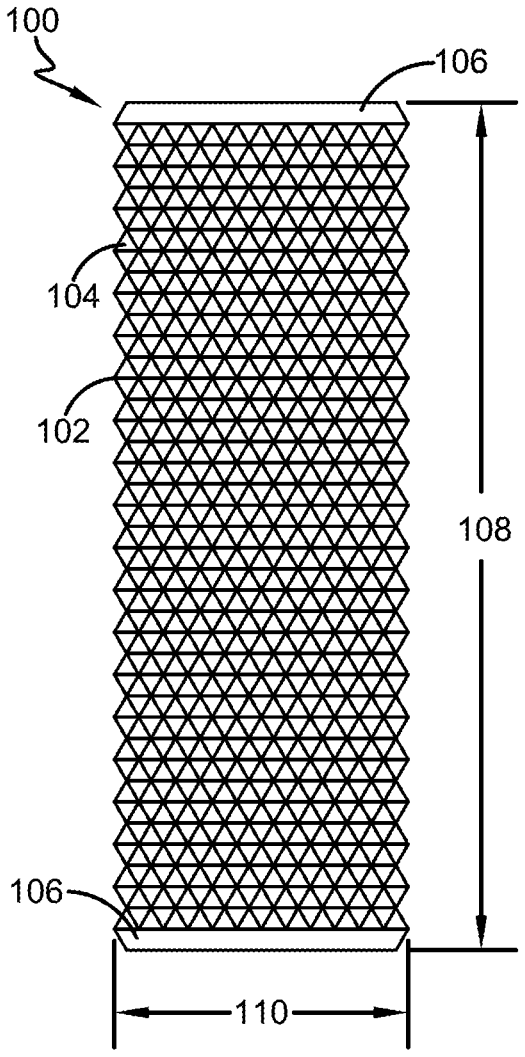
FIG. 1A illustrates a top view of an example smart mat in a flat configuration, in accordance with one or more embodiments.

FIG. 1A illustrates a top view of an example smart mat 100, in accordance with one or more embodiments. The smart mat 100 may be an elongated shape (from a top view, e.g., viewing the mat unrolled and laid out on a flat surface), such as a rectangle or an oval. For example, the smart mat 100 has a length 108 and a width 110, which may be 200 cm and 610 mm, respectively. However, the smart mat 100 is not limited to such shapes or sizes and may take any shape or size. Further, details set forth in this disclosure can be implemented in similar products or devices regardless of shape or size.

Smart mat 100 comprises a plurality of polygons 104. The plurality of polygons 104. In the illustrated embodiment, the plurality of polygons 104 are triangles aligned edge-to-edge such that the widest portion of each row matches the width 110. The polygons can be formed of a single monolithic piece of material or can be assembled individually or in collectively-manufactured groups of polygons (e.g., connected rows, groups of connected rows). The polygons are transparent or semi-transparent (to allow viewing of display elements therein).

Smart mat 100 can comprise additional structure, for example, a floor material 101 and/or ends 106. Floor material 101 can be a material that backs some or all of the polygons 104. When smart mat 100 is in use, it can be laid flat such floor material 101 is in contact with the floor and polygons 104 and their internal display elements are visible from above. In embodiments, transparent or semi-transparent material can overlie polygons 104 on a face opposite floor material 101 such that the smart mat 100 is "enclosed" on both sides. In embodiments, floor material 101 can be formed of an opaque material in contrast with the transparent or semi-transparent material(s) of polygons 104. In embodiments, floor material 101 can be nonuniform or contain discontinuities to allow for smart mat 100 to be rolled or folded with little or no stretching of floor material 101. Floor material 101 can be of sufficient thickness to accommodate other components, such as a controller (or receiver) or battery.

Figure 1B:
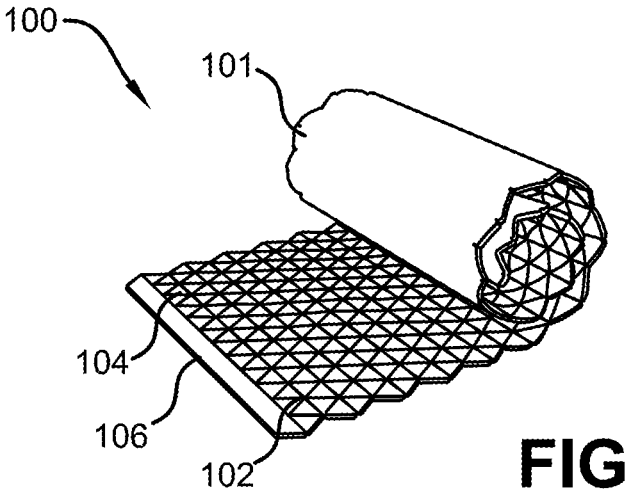
FIG. 1B illustrates a top view of an example smart mat in a flat configuration, in accordance with one or more embodiments.

Smart mat 100 can also include ends 106 on one or more sides. In embodiments, smart mat 100 can include two ends 106 on a first and second end of the mat. In embodiments, smart mat 100 can include only one end 106, or three or more edges spanning some or all of the smart mat 100's sides. In a rounded embodiment or an embodiment with nonlinear features, end 106 may be curved or stepped to follow the side of smart mat 100. Ends 106 can be substantially equivalent to a dimension of a side of smart mat 100 (e.g., ends 106 in FIGS. 1A and 1B are substantially equivalent to width 110). As shown in FIGS. 1A and 1B, ends 106 need not be rectangular, and can be tapered or shaped to align with the design of smart mat 100. For example, as shown in FIGS. 1A and 1B, the triangular polygons 104 create a sawtooth edge pattern on the lengthwise sides, and ends 106 are tapered to continue the pattern. In embodiments, one or more ends 106 can be formed of an opaque material. One or more ends 106 may include a magnetic closure, hook and loop fasteners, buttons, or any other closures for keeping the smart mat 100 in the second configuration.

In alternative embodiments, polygons 104 can be monolithically formed in a single process, with internal components pre-positioned prior to forming polygons 104 (e.g., injection molding, dual- or multi-shot injection molding, overmolding, additive manufacturing or "3D printing," vacuum forming, thermoforming, et cetera). In this manner, no assembly of individual polygons 104 (or groups thereof), and no assembly of polygons 104 with floor material 101 and/or ends 106, is needed.

Polygons 104, floor material 101, ends 106, and/or other portions of smart mat 100 can be formed from a variety of suitable materials. Examples include polymers/copolymers (PVC/vinyl, TPE, polyurethane, EVA), foam, rubber (natural or synthetic), cork, jute, cotton, hemp, et cetera. In an embodiment, one or more of polygons 104, floor materials 101, ends 106, and/or other components can be formed by two or more materials, or can be wrapped or coated on one or more faces with a different material. Materials can be selected to provide appropriate smart mat qualities (e.g., texture, compressibility, flexibility, thickness, breathability and absorption, durability, insulation) to facilitate use of the smart mat 100 as an athletic or yoga mat.

Edges 102 are between two polygons or are where two polygons meet. In embodiments, the edges 102 may be a structurally different area (e.g., a space between polygons that is hollow or filled) from the polygons or other portions of smart mat 100. In embodiments where edge 102 defines a space between polygons 104, the polygons may be arranged flush against one another, or a gap may exist between polygons 104 at edges 102 when the smart mat 100 is laid flat or arranged in any other orientation. In alternative embodiments, the edges 102 may be structurally homogeneous with portion(s) of smart mat 100 (e.g., formed with polygons 104, formed with other portions of smart mat 100, with no discontinuity or gap between polygons 104). In embodiments where edges 102 are structurally homogeneous, the edges may or may not be indicated using color applied to the edges or a treatment to make the edge material opaque. In this way, edges 102 can visually define polygons 104 and be appreciated by users without requiring different materials or additional manufacturing steps.

Other shapes can be used without departing from the scope or spirit of the innovation, and, in alternative embodiments, multiple polygonal shapes, or different sizes of the same shape, can be used without departing from the scope or spirit of the innovation. For example, a single smart mat can include a plurality of triangles and rectangles (e.g., in different rows such that the edges of a rectangle row substantially align against the edges of a triangle row; different triangular shapes with some equilateral and some isosceles), and/or a single smart mat can include a plurality of different-sized shapes (e.g., larger and smaller rectangles aligned in different rows).

Each polygon 104 can include one or more display elements. The display element may include one or more LEDs, an LED display, an OLED display, an e-ink/e-paper display, and/or any other kind of light or display that, individually or in the aggregate, can display an image. The display element in each protrusion may also include a cover to diffuse the light. The cover may be for each protrusion and/or a sheet over multiple protrusions. In this regard, the polygons 104 may function as "pixels" that together form a larger display. The display elements of polygons 104 can be operatively connected to a controller that controls each display element, collectively or individually, regarding when and how to function. For example, the controller can instruct one or more elements to energize (e.g., emit light) in a certain manner (e.g., color of light, brightness of light) at a certain time, and de-energize at another time thereafter. In another example, the controller can instruct one or more first elements to energize during a first time and one or more elements to energize during a second time. In embodiments, display elements are configured to display more complex images (where one or more display elements comprise, e.g., LCD, LED, Plasma, QLED, OLED, or UHD displays) when energized. The controller can be provided as a part of smart mat 100, or the smart mat 100 can include a receiver configured to receive control instructions from another system (e.g., mobile device, application, remote control), which can communicate with the receiver in a wired or wireless manner. The controller (or receiver), as well as a power supply for operating the display elements and controller (or receiver), can be located within one or more polygons 104. In embodiments using a floor material 101, the controller (or receiver) can be disposed in at least a portion of floor material 101. Further, the display elements within polygons 104 can be arranged in electrical communication with the controller (or receiver) and/or one or more batteries, which may include placing one or more of the display elements in electrical communication with one another.

FIG. 1B illustrates the example smart mat 100 of FIG. 1A in a rolled configuration, in accordance with one or more embodiments. The plurality of polygons 104 can be discrete elements, which provides flexibility in the smart mat 100 that a single display may not provide. In alternative embodiments where one or more polygons 104 are not formed as discrete elements, polygons 104 and other materials can be formed of a sufficiently flexible material to allow rolling without user difficulty or damage to the display elements and associated electronics. This flexibility allows the smart mat 100 to be rolled, folded, or otherwise made more compact. For example, as shown in FIG. 1B, the edges 102 and polygons 104 allow for the smart mat 100 to be rolled, such as in the longitudinal direction depicted. In alternative or complementary embodiments, the smart mat 100 may be rolled in a lateral (e.g., perpendicular to the longitudinal roll shown in FIG. 1B) or other direction.

The embodiments of, e.g., FIGS. 2A, 2B, 3, 4, and 5 illustrate smart mats disclosed herein that are formed of various layered arrangements and/or utilize cutouts for polygons and display elements. Such embodiments show specific manners of constructing a smart mat disclosed herein, but should not be deemed to limit the embodiments described in relation to FIGS. 1A and 1B. More, it will be appreciated on review of this disclosure that portions of embodiments described in relation to FIGS. 1A and/or 1B can be utilized with the embodiments of subsequent drawings without departing from the scope or spirit of the innovation (e.g., the embodiment of FIGS. 2A and 2B could use a flat, rather than slatted, bottom surface). Other variants will be appreciated, based on the entirety of the disclosure, that allow for a smart mat formed of transparent or semi-transparent polygons containing display elements to be implemented.

Figure 2A:
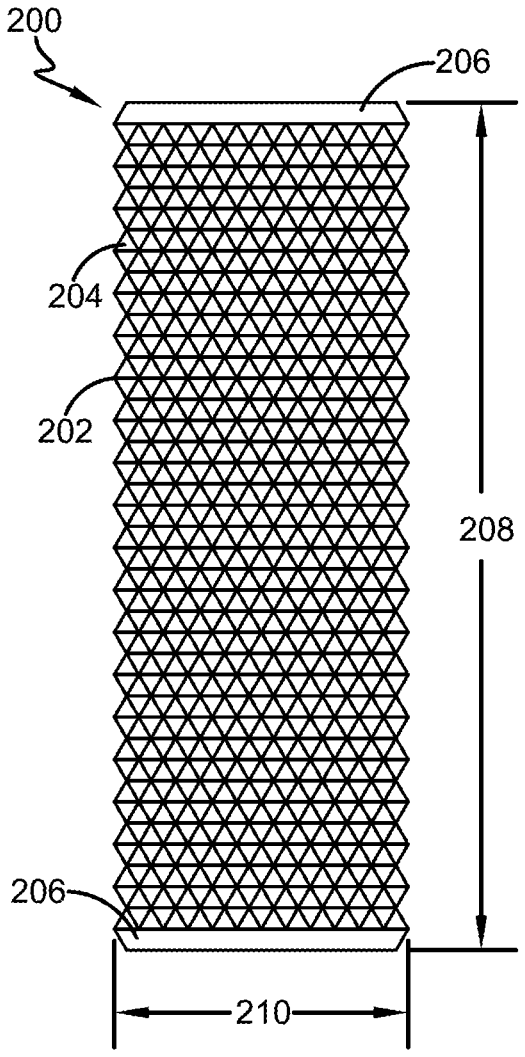
FIG. 2A illustrates a top view of an example smart mat in a flat configuration, in accordance with one or more embodiments.

FIG. 2A illustrates a top view of an example smart mat 200, in accordance with one or more embodiments. The smart mat 200 may be an elongated shape (from a top view, e.g., viewing the mat unrolled and laid out on a flat surface), such as a rectangle or an oval. For example, the smart mat 200 of FIG. 2, has a length 208 and a width 210, which may be 200 cm and 610 mm, respectively. However, the smart mat 200 is not limited to such shapes, and may take any shape. Further, details set forth in this disclosure can be implemented in similar products or devices regardless of shape or size.

The smart mat 200 includes a plurality of layers. One or more of the layers may include interstices 202, and one or more of the layers may include protrusions 204, which may extend through the interstices 202. The plurality of interstices 202 and the plurality of protrusions 204 may be of any shape such that the plurality of protrusions 204 are visible through the plurality of interstices 202. For example, as shown in FIG. 2A, the plurality of interstices 202 and the plurality of protrusions 204 have a substantially polygonal shape (e.g., triangles). In alternative embodiments, the plurality of interstices 202 and the plurality of protrusions 204 can have any shape and/or may include shapes of different sizes or orientations. In further alternative embodiments, one or more of the plurality of interstices 202 can have a first shape and another or more of the plurality of interstices 202 can have a second shape. One or more additional of the plurality of interstices 202 can have a third, fourth, et cetera, shape. Likewise, one or more of the plurality of protrusions 204 can have other shapes, which may or may not correspond to the different shapes of any of the plurality of interstices 202. These alternative embodiments are only intended to provide some examples, not an exhaustive list of possibilities, and other combinations of shapes and sizes will be appreciated by those of skill in the art on review of the disclosure.

In embodiments, interstices 202 can be cutouts. In embodiments, interstices 202 can be formed during manufacturing using, e.g., dual injection molding. In embodiments, interstices 202 can be partially or wholly filled or covered with a transparent or semi-transparent material.

Each protrusion of the plurality of protrusions 204 may include its own display element. The display element in each protrusion may include one or more LEDs, an LED display, an OLED display, an e-ink/e-paper display, and/or any other kind of light or display that, individually or in the aggregate, can display an image. The display element in each protrusion may also include a cover to diffuse the light. The cover may be for each protrusion and/or a sheet over multiple protrusions. In this regard, the plurality of protrusions 204 may function as "pixels" that together form a larger display.

Figure 2B:
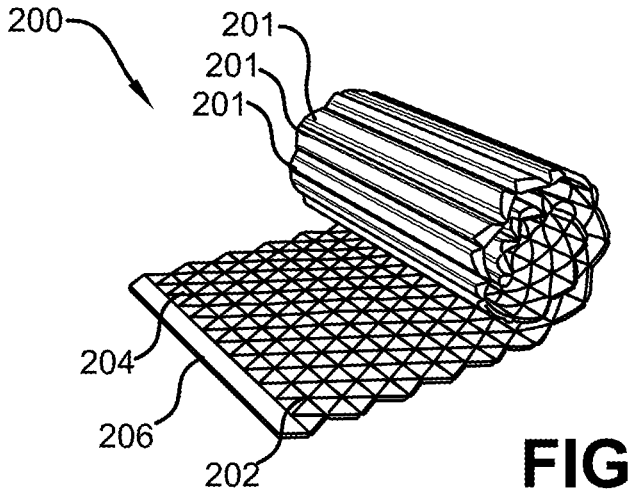
FIG. 2B illustrates the example smart mat of FIG. 1A in a rolled configuration, in accordance with one or more embodiments.

FIG. 2B illustrates the example smart mat 200 of FIG. 2A in a rolled configuration, in accordance with one or more embodiments. The plurality of protrusions 204 are discrete shapes, which provides flexibility in the smart mat 200 that a single display cannot provide. This flexibility allows the smart mat 200 to be rolled, folded, or otherwise made more compact. For example, as shown in FIG. 2B, the triangular interstices 202 and protrusions 204 allow for the smart mat 200 to be rolled, such as in the longitudinal direction depicted. In alternative or complementary embodiments, the smart mat 200 may be rolled in a lateral (e.g., perpendicular to the longitudinal roll shown in FIG. 2B) or other direction.

In addition, the bottom of the smart mat 200 may include a plurality of shapes different from the interstices 202 and protrusions 204. For example, as shown in FIG. 2B, the bottom of the mat includes a plurality of base slats 201. The base slats 201 extend laterally across the smart mat 200. The base slats 201 are shaped such that they may include a hollow cavity (e.g., for storing electronic components). For example, the shape may be any three-dimensional shape, such as a prism (e.g., as shown in FIG. 3B) or a cylinder. The base slats 201 provide rigidity and protection for the items (e.g., electronic components) that may be stored in the base slats 201. To allow the smart mat 200 to be rolled, as shown in FIG. 2B, the base slats 201 may be a plurality of discrete shapes. For example, a plurality of base slats 201 may be placed against each other down the length of the smart mat 200 and may be rotatably connected with each other such that they can be rolled.

The smart mat 200 may also include ends 206. The smart mat 200 may be in a first configuration when in use and a second configuration when not in use. For example, the smart mat 200, as shown in FIG. 2A, is laid flat when in use and rolled when not in use. The ends 206 may be used to retain the smart mat 200 in the second configuration. For example, the ends 206 may include a magnetic closure, hook and loop fasteners, buttons, or any other closures for keeping the smart mat 200 in the second configuration.

Figure 3:
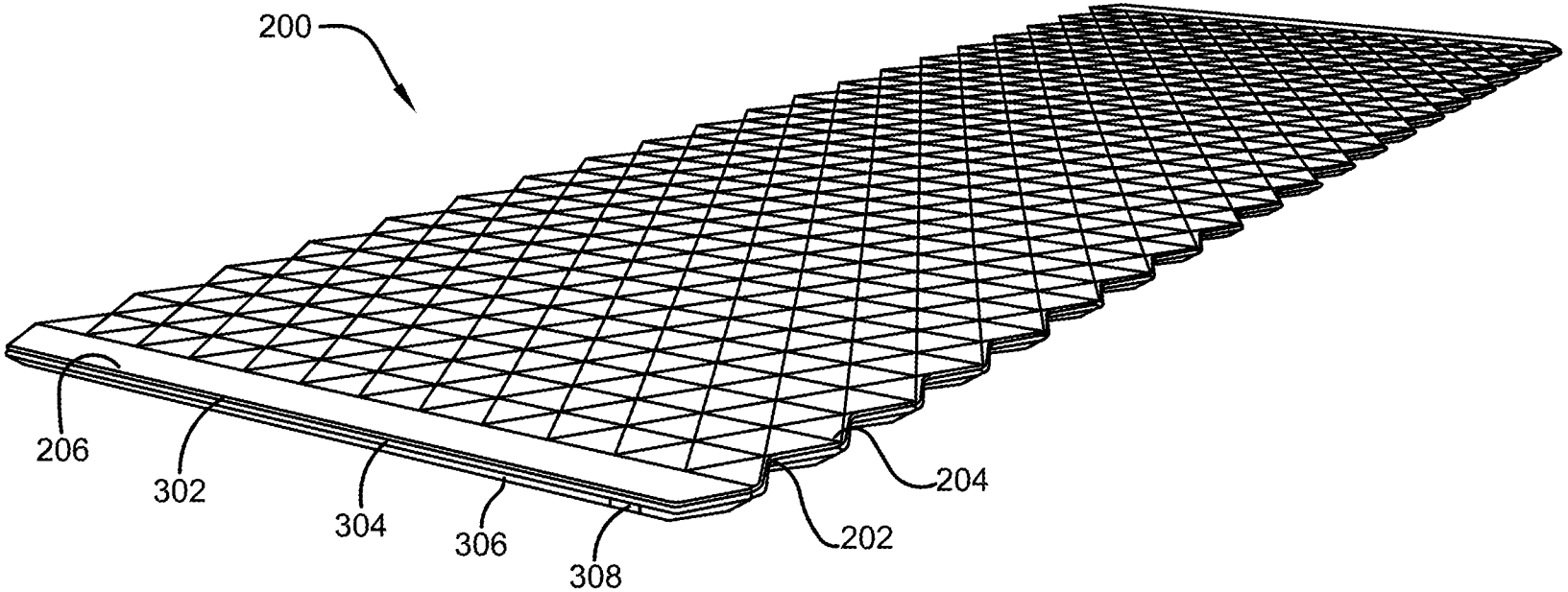
FIG. 3 illustrates a perspective view of the example smart mat of FIG. 1A, in accordance with one or more embodiments.

FIG. 3 illustrates a perspective view of the example smart mat 200 of FIG. 2, in accordance with one or more embodiments. Not all of the depicted components may be used in all embodiments, however, and one or more embodiments may include additional or different components than those shown in the figure. Variations in the arrangement and type of the components may be made without departing from the spirit or scope of the claims as set forth herein. Additional components, different components, or fewer components may be provided.

The smart mat 200 may include multiple layers. The smart mat 200 includes a first layer 302. The first layer 302 is made from a soft, pliable material, including natural materials (e.g., cotton, jute, rubber, cork, and the like) and/or synthetic materials (e.g., polyester, nylon, foam, vinyl, and the like). In embodiments, the first layer 302 can be at least partly compressible or cushioned. In embodiments, the first layer 302 can include water or fluid resistant qualities and/or be non-absorbent. The first layer 302 includes one or more interstices 202. Interstices 202 may include holes, cuts, punch outs, and other interstices that pass through the first layer 302, as well as interstices that only make the first layer 302 thinner (e.g., such that light may pass through). The interstices 202 may have any shape and may be uniform or non-uniform. For example, as shown in FIG. 3, the interstices 202 are triangles that are cut through the first layer 302 and are uniform throughout the first layer 302.

The smart mat 200 includes a second layer 304. The second layer 304 is made from a soft, pliable material that has transparent or semi-transparent qualities, such as silicone rubber, neoprene, and the like. In embodiments, the second layer 304 can be at least partly compressible or cushioned. In embodiments, the second layer 304 can include water or fluid resistant qualities and/or be non-absorbent. The second layer 304 has a top surface that may be connected to the bottom surface of the first layer. The first layer 302 and the second layer 304 may be connected together by stitching, adhering, welding, or any other form of connecting two soft, pliable materials. The second layer 304 includes one or more protrusions 204. The protrusions 204 may correspond to the interstices 202 of the first layer 302. For example, the protrusions 204 may correspond to the interstices 202 such that, when the second layer 304 is connected to the first layer 302, the protrusions 204 are flush with the top surface of the first layer 302. In alternative embodiments, the protrusions 204 can be recessed or extend past the top surface of the first layer 302 without departing from the scope or spirit of the innovation.

"Corresponding" may refer to a one-to-one correspondence or correspondence in which each protrusion has a cavity (e.g., there are more interstices than protrusions). Additionally, a protrusion and a corresponding cavity are not necessarily the same shape or size. For example, the protrusion may be smaller than the cavity from which the protrusion protrudes (e.g., a circular cavity with a two-inch diameter and a protrusion with a maximum width of one inch). It should be understood that the description of protrusions 204 and interstices 202 are not limited to specific shapes, sizes, or other dimensions discussed herein.

In one or more embodiments, the smart mat 200 includes a third layer 308. The third layer 306 is made from a substantially non-compressible material, including natural materials (such as rubber) and/or synthetic materials (such as foam and plastic). The second layer 304 and the third layer 306 may be connected together by stitching, adhering, welding, or any other form of connecting a soft material and a substantially non-compressible material. In one or more embodiments, the first layer 302, the second layer 304, and the third layer 306 may be connected. In one or more embodiments, the first layer 302 and the third layer 306 may be connected such that the second layer 304 is held in place.

The third layer 308 may include a plurality of walls that are formed into shapes from which a cavity is formed. For example, as shown in FIG. 2B, the bottom of the mat includes a plurality of three-dimensional shapes extended laterally, such as a prism or cylinder. The cavities of the third layer 308 may be used to house one or more electronic components that may be communicatively coupled to each other and/or one or more of the display elements of the second layer 304. To allow the smart mat 200 to be rolled, as shown in FIG. 2B, the third layer 308 may include a plurality of discrete shapes. For example, a plurality of base slats 201 may be placed against each other down the length of the smart mat 200 and may be rotatably connected with each other such that they can be rolled. Additionally, the third layer 308 may include a charging contact for coupling to a power source. The charging contact may include conductive pins, ports (e.g., USB-C™), magnetic coils (e.g., Qi® wireless power), and the like.

Figure 4:
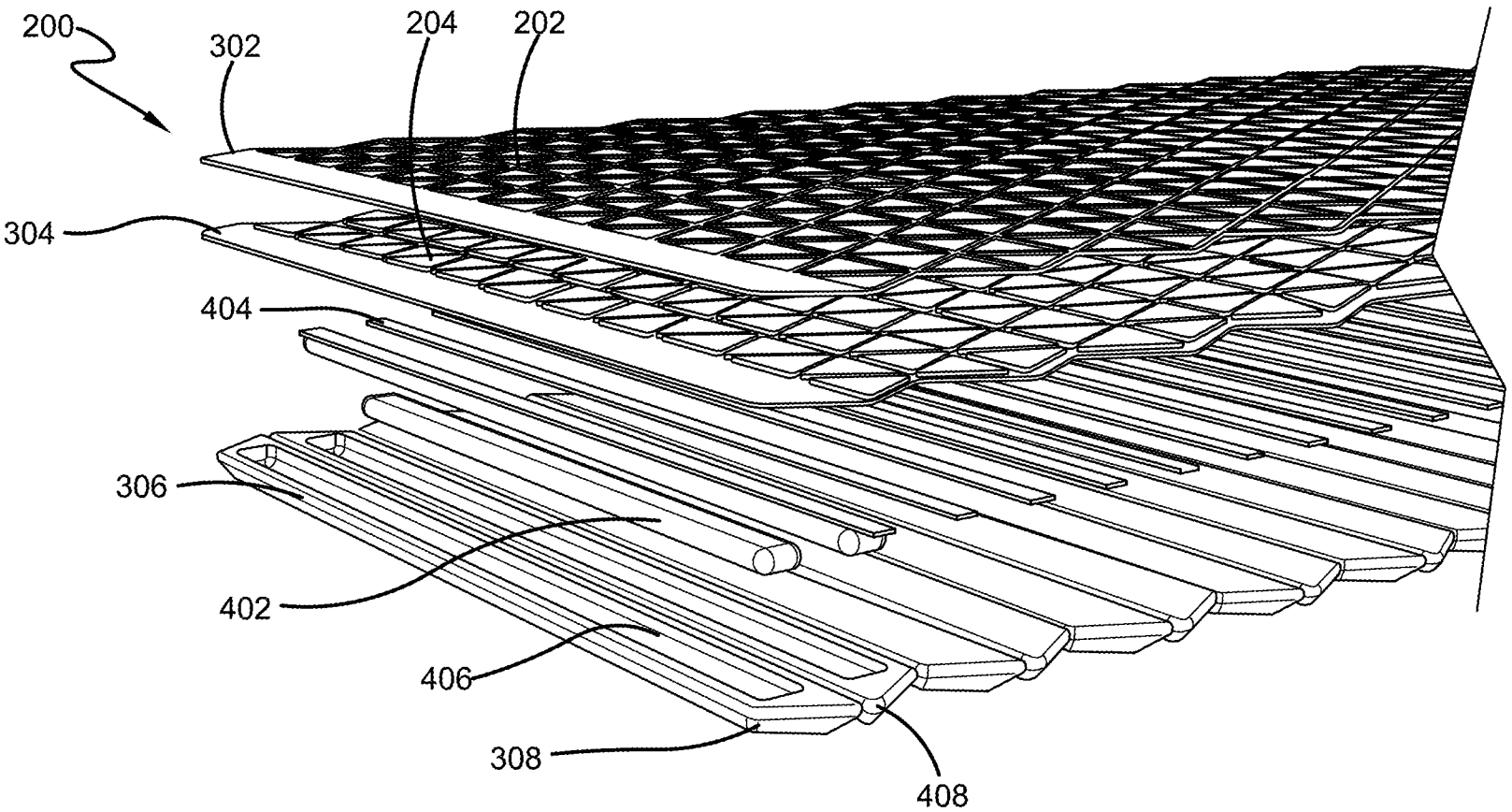
FIG. 4 illustrates an exploded view of a portion of the example smart mat of FIG. 1A, in accordance with one or more embodiments.

FIG. 4 illustrates an exploded view of a portion of the example smart mat 200, in accordance with one or more embodiments. Not all of the depicted components may be used in all embodiments, however, and one or more embodiments may include additional or different components than those shown in the figure. Variations in the arrangement and type of the components may be made without departing from the spirit or scope of the claims as set forth herein. Additional components, different components, or fewer components may be provided.

In the example of FIG. 4, the smart mat 200 includes three layers 302, 304, 306. The first layer 302 is made from a foam material and includes interstices 202 that are uniform triangular interstices in the material. The second layer 304 is made from a silicone rubber material and includes protrusions 204 that extend from the second layer 304. Each of the protrusions 204 include at least one LED light and have substantially the same shape and size as the interstices 202 such that each protrusion has a corresponding cavity and the protrusions 204 fit through the interstices 202. In alternative embodiments, only a subset of the plurality of protrusions 204 include at least one LED light. The third layer 306 is made from a rubberized plastic material. The third layer 308 includes one or more walls that are molded into one or more prisms 408 that extend laterally. The prisms 408 are molded such that they have a plurality of walls that define a cavity 406. The cavities 406 may be used to store one or more electronic components 402 that may be communicatively coupled to each other and/or one or more of the display elements of the second layer 304. The cavities 406 may be used to store one or more batteries 404. In one or more embodiments, the cavities 406 may be used to store additional lighting elements. Additionally, the third layer 308 may include a charging contact for coupling to a power source. The power source may be used to charge the one or more batteries 404.

In one or more embodiments, the first and/or second layers 302, 304 may include one or more sensors. The sensors may be communicatively coupled to the electronic components 402. Sensors may include pressure sensors, proximity sensors, bioimpedance sensors, temperature sensors, moisture sensors, capacitive touch sensors, and/or the like. The electronic components 402 may include a transceiver that can store, process, transmit, or otherwise utilize the data. For example, the electronic components 402 may transmit the sensor data to an external device for tracking usage, movement accuracy, user performance, and other feedback from user activity.

Figure 5:
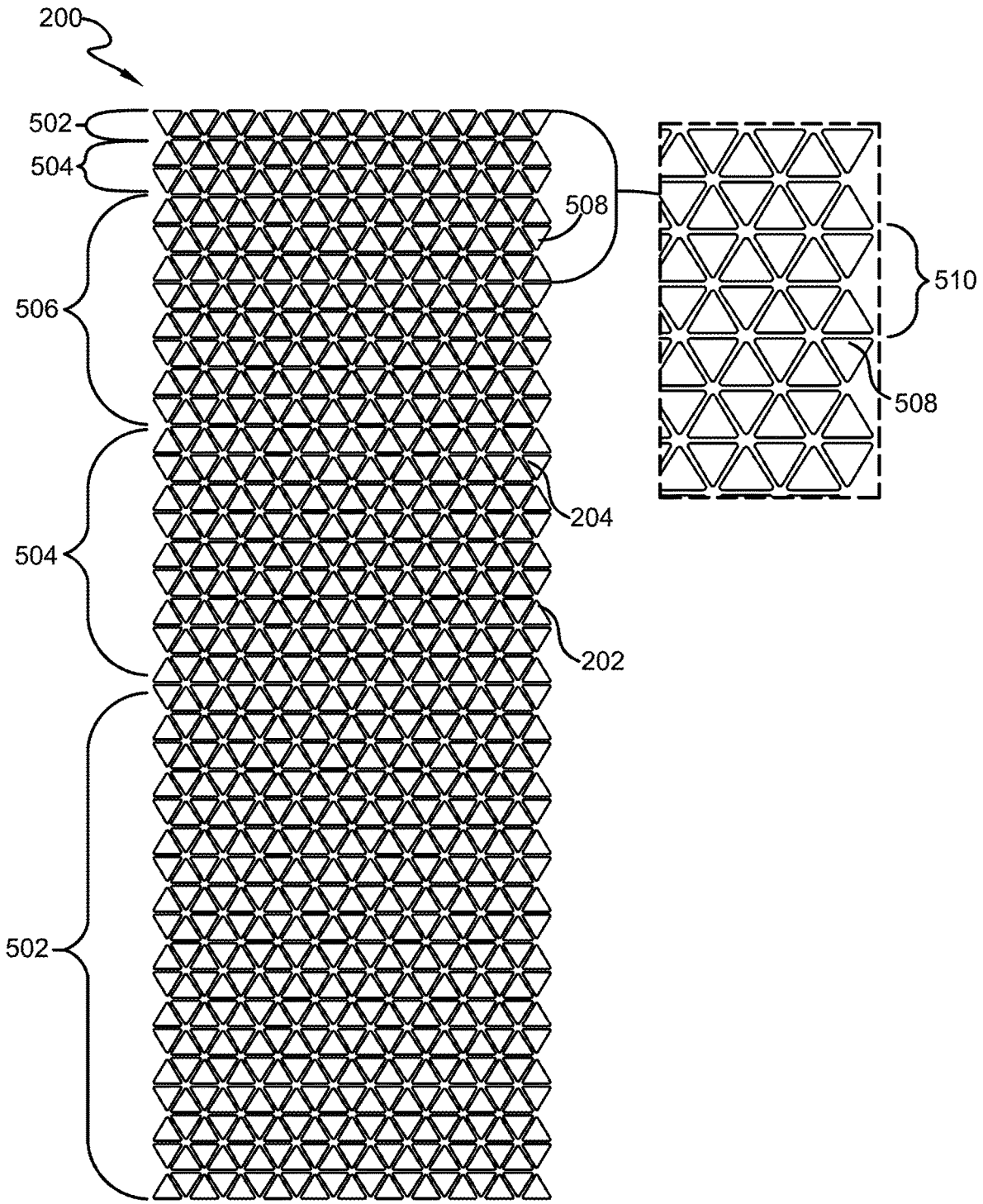
FIG. 5 illustrates a top view of a second example smart mat, in accordance with one or more embodiments.

FIG. 5 illustrates a top view of the example smart mat 200, in accordance with one or more embodiments. Not all of the depicted components may be used in all embodiments, however, and one or more embodiments may include additional or different components than those shown in the figure. Variations in the arrangement and type of the components may be made without departing from the spirit or scope of the claims as set forth herein. Additional components, different components, or fewer components may be provided.

Each protrusion of the plurality of protrusions 204 may include its own display element. The display element in each protrusion may include one or more LEDs, an OLED display, an e-ink/e-paper display, and/or any other kind of light or display that, individually or in the aggregate, can display an image. The display element in each protrusion may also include a cover to diffuse the light. The cover may be for each protrusion and/or a sheet over multiple protrusions 204. In this regard, the plurality of protrusions 204 may function as pixels that together form a larger display.

The plurality of protrusions 204 may be divided into one or more zones 502, 504, 506. Each zone 502, 504, 506 may be differentiated from the others by the type of display element used, the colors that can be created, the number of display elements per protrusion, and the like. The zones 502, 504, 506 may each include one or more of the protrusions 204. For example, as shown in FIG. 5, the zones 502, 504, 506 are differentiated by the number of display elements per protrusions, where the protrusion 204 of the first zone 502 include one display element, the protrusions 204 of the second zone 504 include three display elements, and the protrusions 204 of the third zone 506 include sixteen display elements. In one or more embodiments, the protrusions 204 can include multiple zones 502, 504, 506 (e.g., protrusion 508 includes the zones 504, 506).

In one or more embodiments, the zones 502, 504, 506 may overlap. For example, the area 510 shows zone 502 moving into zone 504, and zone 504 moving into zone 506.

In one or more embodiments, the zones 502, 504, 506 may be independent and/or dynamic based on a programmed control. For example, the zones may operate independently and/or perform different display operations based on rules or instructions that are user programmed, pre-programmed, et cetera.

In one or more embodiments, the size of the interstices 202 may correspond to the size of the protrusions 204. For example, one zone may include protrusions 204 that are 3 cm wide, where as another zone may include protrusions 204 that are 6 cm wide.

In one or more embodiments, the zones 502, 504, 506 are differentiated by the number of protrusions 204 per interstice 202. For example, as shown in FIG. 5, each interstice 202 in a zone 504 may include four protrusions 204, and each interstice 202 in a zone 502 may include one protrusion 204.

In one or more embodiments, the zone sizes can be the same or different sizes. For example, one zone may include 10 protrusions 204, whereas another zone may include 20 protrusions.

Figure 6:
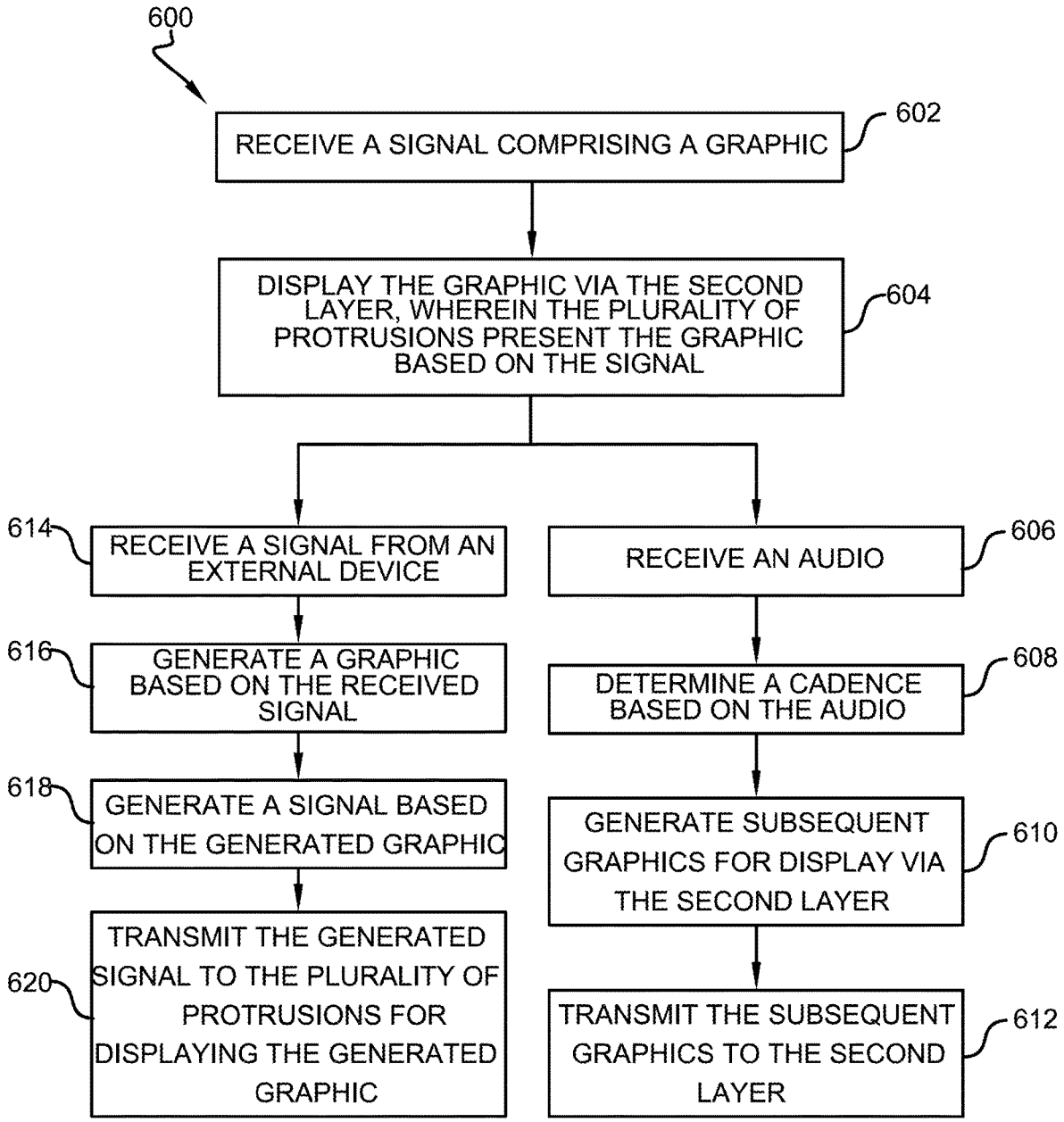
FIG. 6 illustrates a flow diagram of an example process for utilizing a smart mat, in accordance with one or more embodiments.

FIG. 6 illustrates a flow diagram of an example process 600 of smart mat 200 operations, in accordance with one or more embodiments. For explanatory purposes, the process 600 is primarily described herein with reference to FIG. 4. For explanatory purposes, the blocks of the process 600 are described herein as occurring in serial or linearly. However, multiple blocks of the process 600 may occur in parallel. In addition, the blocks of the process 600 need not be performed in the order shown and/or one or more blocks of the process 600 need not be performed and/or can be replaced by other operations.

In the example process 600, at block 602, the electronic component 402 may receive a signal. The signal may be from an external device, such as a smartphone, an integrated device, such as a touch screen display, or any other kind of input interface. The signal may be received via wired or wireless communication, such as Bluetooth®. The signal may include a graphic to be reproduced by the smart mat 200. For example, the signal may include instructions for the display elements of the protrusions 204 to illuminate in such a way as to form the graphic. The signal may also or instead be an initialization message that instructs the electronic component 402 to begin generating graphics. For example, the signal may be an input from the user to initialize displaying a graphic and/or a type of graphic to be displayed. It should be understood that the plurality of protrusions 204 may be configured to present a graphic based on a signal from the electronic component 402. The signal may also or instead include instructions regarding the timing, display, configuration, and/or any other modification to a graphic.

At block 604, the graphic may be displayed via the second layer 304. The graphic may be displayed via the protrusions 204. The protrusions 204 may be illuminated in such a way as to form the graphic. Displaying the graphic may be based on the received signal. For example, the signal may include one or more instructions to one or more display elements of one or more protrusions 204 for reproducing the graphic, where each protrusion 204 may function as a portion (e.g., a pixel) of the graphic. From block 604, the process 600 may proceed to block 606. The graphic may include one or more graphics displayed at the same or different times. For example, the top half of the smart mat 200 may present a different graphic than the bottom half of the smart mat 200. Additionally, the graphics may be still or dynamic. For example, the graphic may be GIF or any other form of motion graphic.

At block 606, the electronic component 402 may receive audio. The audio may be an audio file (e.g., an .MP3, WAV, or other audio files), audio signals (e.g., from an audio sensor such as a microphone), and the like. In one or more embodiments, the electronic component 402 may be communicatively connected to an external device from which the audio may be received. For example, the electronic component 402 of the smart mat 200 may be in wireless communication with a smartphone on the same network via Wi-Fi, and the audio may be streamed from the smartphone to the electronic component 402. In one or more embodiments, the electronic component 402 may include a speaker for reproducing the received audio.

At block 608, the electronic component 402 may determine a cadence based on the received audio. A cadence may be a beat of the audio, a rhythm of the audio, or any other pattern based on the audio. The cadence may be determined, for example, by identifying sudden impulses of sound in the audio and determining the periods at which the graphic(s) corresponding to each of the impulses appear. As another example, the electronic component 402 may analyze an envelope of the audio's low-end frequency (e.g., sub-100 Hz) in which a beat (e.g., from a kick drum) can be identified by determining volume peaks beyond a threshold level.

At block 610, the electronic component 402 may generate subsequent graphics for display. A subsequent graphic is a graphic presented after the graphic of block 604. For example, subsequent graphics may be used to generate a series of graphics (e.g., frames) to give the graphic the appearance of motion (e.g., a video). To generate subsequent graphics, the electronic component 402 may receive subsequent signals in a manner similar to the signal of block 602. Additionally or alternatively, the subsequent graphics may be based on the signal of block 602 and/or the audio of block 606. For example, the signal may be an initialization message received from the user for the electronic device 402 to begin generating graphics, after which the electronic device 402 generates a series of graphics according to predetermined instructions, user-provided preferences, an audio, and/or the like. It should be understood that the plurality of protrusions 204 may be configured to present subsequent graphics based on a plurality of signals from the electronic component 402 corresponding to the cadence determined in block 608. The signal may also or instead include instructions regarding the timing, display, configuration, and/or any other modification to a graphic based on the audio.

At block 612, the electronic component 402 may generate subsequent signals based on the subsequent graphics for transmitting the subsequent graphics to the second layer 304. The subsequent graphics may be displayed via the protrusions 204 of the second layer 304. The protrusions 204 may be illuminated in such a way as to form one or more graphics of the subsequent graphics. Displaying the subsequent graphics may be based on the received subsequent signals. For example, a signal of the subsequent signals may include one or more instructions to one or more display elements of one or more protrusions 204 for reproducing the graphic, where each protrusion 204 may function as a portion (e.g., a pixel) of the graphic. A subsequent signal may be sent to the second layer 304 after generation of the signal. In one or more embodiments, the subsequent signals may be sent as a batch after filling a buffer of signals. In one or more embodiments, a subsequent signal may be sent after a time period of displaying the currently displayed image. In one or more embodiments, the subsequent signal may be sent according to the cadence of block 608. In one or more embodiments, the second layer 304 may include a buffer for receiving the subsequent signals and may present the subsequent signals according to an instruction in the signals.

From block 604, the process 600 may also or instead proceed to block 614.

At block 614, the electronic component 402 may receive a signal from an external device. The external device may be an electronic device, such as a computer, smartphone, tablet, smartwatch, and the like. The external device may be directly or indirectly communicatively coupled to the electronic component 402 via wired and/or wireless protocols, such as USB, Bluetooth®, Wi-Fi, and the like. The electronic component 402 may be coupled to sensors connected to the smart mat 200 (e.g., on the first layer 302), such as a bioimpedance sensor, to generate health data, exercise metrics, or any other user-related data to transmit to the external device for processing.

At block 616, the electronic component 402 may generate a graphic based on the received signal. The signal may include one or more instructions to generate one or more display elements of one or more protrusions 204 for reproducing the graphic, where each protrusion 204 may function as a portion (e.g., a pixel) of the graphic. For example, the external device may stream an image or set of images (e.g., a video) to the electronic component 402, where the stream includes multiple signals containing one or more images for display on the smart mat 200. Block 616 may be performed in a manner similar to block 610, the description of which will not be reproduced.

At block 618, the electronic component 402 may generate a signal based on the generated graphic for transmitting the generated graphic to the second layer 304. The signal may include one or more instructions to one or more display elements of one or more protrusions 204 for reproducing the graphic. One or more protrusion 204 may function as a portion (e.g., a pixel) of the graphic.

At block 620, the electronic component 402 may transmit the generated signal to the second layer 302. The graphic may be displayed via the protrusions 204 of the second layer 304 based on the signal. Block 620 may be performed in a manner similar to block 612, the content of which will not be reproduced.

In one or more embodiments, the external device generates a second signal. The second signal may be sent to a second external device (e.g., a TV) for generating a second graphic. For example, a smartphone may be communicatively coupled to the smart mat 200 and a TV over a Wi-Fi network. The external device may coordinate graphics, audio, or any other data between the smart mat 200 and the second external device such that the smart mat 200 and the second external device are in sync. For example, the smartphone may stream a workout video to the TV and the audio and workout metrics (e.g., time remaining) to the smart mat 200. In one or more embodiments, the graphic displayed by the exercise mat may correspond to the graphic displayed by the second external device. For example, the TV may display a workout video, and the smart mat 200 may display a set of graphics that correspond to the music of the workout video (e.g., based on the cadence of the music).

Figure 7:
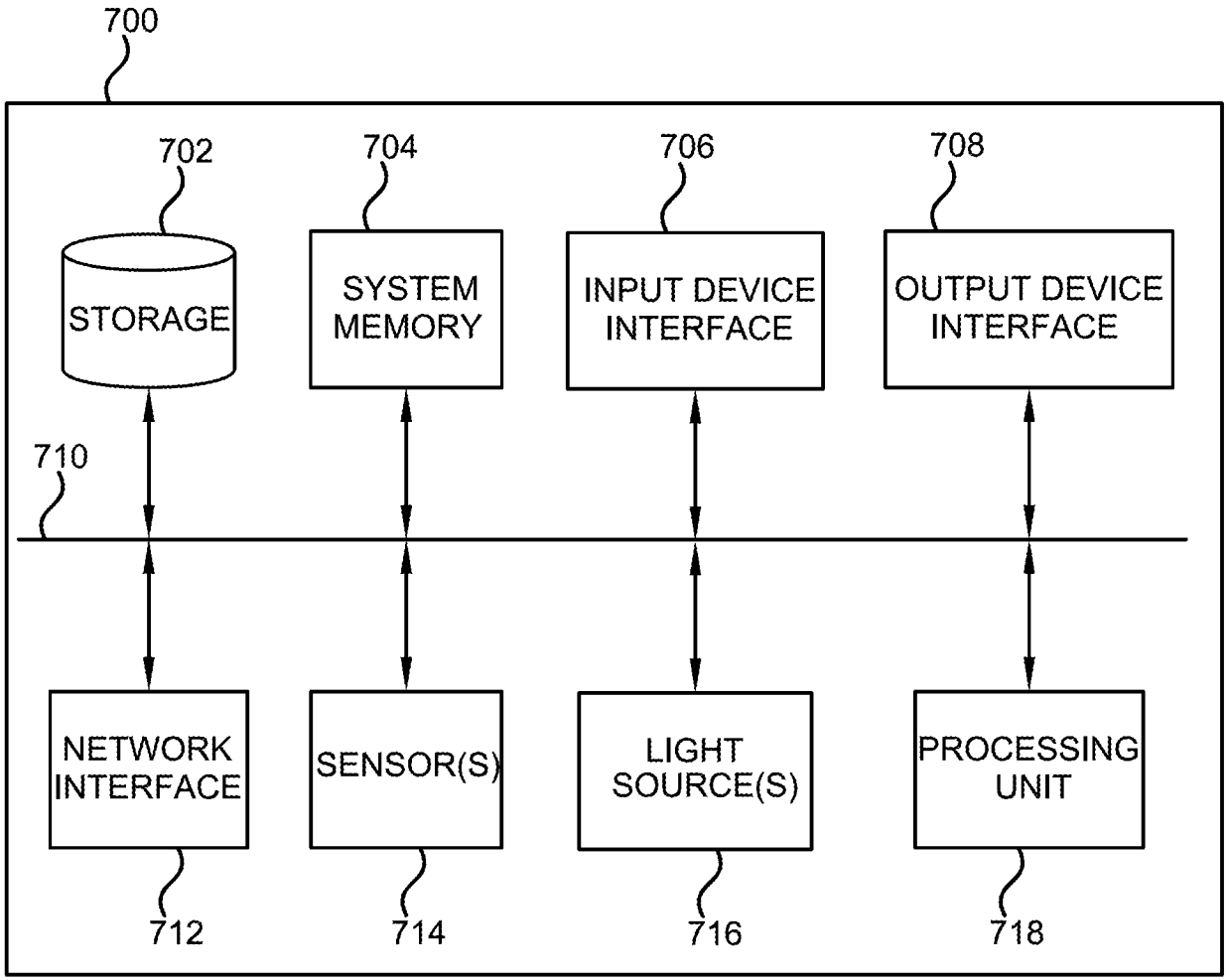
FIG. 7 illustrates an electronic device with which one or more embodiments of the subject technology may be implemented.

FIG. 7 illustrates an electronic component 700 with which one or more embodiments of the subject technology may be implemented. The electronic component 700 can be a part of, e.g., mat 200 or any mat herein. For example, the electronic component 700 may be embedded within a layer of the mat, such as the third layer, as shown in FIG. 4. The electronic component 700 may include various types of computer-readable media and interfaces for various other types of computer-readable media. The electronic component 700 includes a bus 710, a processing unit 718, a system memory 704, a storage device 702, an input device interface 706, an output device interface 708, sensor(s) 714, light source(s) 716, and a network interface 712, or subsets and variations thereof.

The bus 710 collectively represents all system, peripheral, and chipset buses that communicatively connect the numerous internal devices of the electronic component 700. In one or more embodiments, the bus 710 communicatively connects the processing unit 718 with the other components of the electronic component 700. From various memory units (e.g., the system memory 704), the processing unit 718 retrieves instructions to execute and data to process in order to execute the operations of the subject disclosure. The processing unit 718 can be a controller and/or a single- or multi-core processor or processors in various embodiments.

The storage device 702 may be a read-and-write memory device. The storage device 702 may be a non-volatile memory unit that stores instructions and data (e.g., static and dynamic instructions and data) even when the electronic component 700 is off. In one or more embodiments, a mass-storage device (such as a magnetic or optical disk and its corresponding disk drive) may be used as the storage device 702. In one or more embodiments, a removable storage device (such as a floppy disk, flash drive, and its corresponding disk drive) may be used as the storage device 702.

Like the storage device 702, the system memory 704 may be a read-and-write memory device. However, unlike the storage device 702, the system memory 704 may be a volatile read-and-write memory, such as random access memory. The system memory 704 may store any of the instructions and data that one or more processing unit 718 may need at runtime to perform operations. In one or more embodiments, the processes of the subject disclosure are stored in the system memory 704 and/or the storage device 702. From these various memory units, the one or more processing unit 718 retrieves instructions to execute and data to process in order to execute the processes of one or more embodiments.

The bus 710 also connects to the input device interface 706 and output device interface 708. The input device interface 706 enables the system to receive inputs. For example, the input device interface 706 allows a user to communicate information and provide commands to the electronic component 700. The input device interface 706 may be used with input devices such as keyboards, mice, and other user input devices as well as microphones, cameras, and other sensor devices (e.g., sensors 714). The output device interface 708 may enable, for example, the display of images, such as images generated by electronic component 700 or received via the input device interface 706. Output devices that may be used with the output device interface 708 may include, for example, printers and display devices, such as a liquid crystal display (LCD), a light emitting diode (LED) display, an organic light emitting diode (OLED) display, a flexible display, a flat panel display, a solid state display, an e-ink/e-paper display, or any other device for outputting information. Output devices may comprise one or more light sources (e.g., light sources 716). One or more embodiments may include devices that function as both input and output devices, such as a touchscreen. In these embodiments, feedback provided to the user can be any form of sensory feedback, such as visual feedback, auditory feedback, or tactile feedback; and input from the user can be received in any form, including acoustic, speech, or tactile input.

The bus 710 also couples the electronic component 700 to one or more networks and/or to one or more network nodes (e.g., other electronic devices) through the network interface 712. The network interface 712 may include one or more interfaces that allow the electronic component 700 to be a part of a network of computers (such as a local area network (LAN), a wide area network ("WAN"), or a network of networks (the "Internet")). Any or all components of the electronic component 700 can be used in conjunction with the subject disclosure.

The electronic component 700 also includes one or more light sources 716. The light sources 716 may be the light source from which images are displayed. The light sources 716 may be a single light source and/or an array of light sources in one or more protrusions of the second layer of the mat. For example, the light sources 716 may be an LED or an array of LEDs.

The electronic component 700 also includes one or more sensors 714. The sensors 714 may be used for generating exercise data, receiving user input (e.g., to supply to the input device interface 706), and the like. For example, sensors 714 may include a pressure sensor, proximity sensor, bioimpedance sensor, and the like, to determine whether a user is on the mat. As another example, sensors 714 may also include a capacitive touch sensor for the user to provide input.

Embodiments within the scope of the present disclosure can be partially or entirely realized using a tangible computer-readable storage medium (or multiple tangible computer-readable storage media of one or more types) encoding one or more instructions. The tangible computer-readable storage medium also can be non-transitory in nature.

The computer-readable storage medium can be any storage medium that can be read, written, or otherwise accessed by a general-purpose or special-purpose computing device, including any processing electronics and/or processing circuitry capable of executing instructions. For example, without limitation, the computer-readable medium can include any volatile semiconductor memory (e.g., the system memory 704), such as RAM, DRAM, SRAM, T-RAM, Z-RAM, and TTRAM. The computer-readable medium also can include any non-volatile semiconductor memory (e.g., the storage device 702), such as ROM, PROM, EPROM, EEPROM, NVRAM, flash, nvSRAM, FeRAM, FeTRAM, MRAM, PRAM, CBRAM, SONOS, RRAM, NRAM, racetrack memory, FJG, and Millipede memory.

Further, the computer-readable storage medium can include any non-semiconductor memory, such as optical disk storage, magnetic disk storage, magnetic tape, other magnetic storage devices, or any other medium capable of storing one or more instructions. In one or more embodiments, the tangible computer-readable storage medium can be directly coupled to a computing device, while in other embodiments, the tangible computer-readable storage medium can be indirectly coupled to a computing device, e.g., via one or more wired connections, one or more wireless connections, or any combination thereof.

Instructions can be directly executable or can be used to develop executable instructions. For example, instructions can be realized as executable or non-executable machine code or as instructions in a high-level language that can be compiled to produce executable or non-executable machine code. Further, instructions also can be realized as or can include data. Computer-executable instructions also can be organized in any format, including routines, subroutines, programs, data structures, objects, modules, applications, applets, functions, etc. As recognized by those of skill in the art, details including, but not limited to, the number, structure, sequence, and organization of instructions can vary significantly without varying the underlying logic, function, processing, and output.

While the above discussion primarily refers to microprocessors or multi-core processors that execute software, one or more embodiments are performed by one or more integrated circuits, such as ASICs or FPGAs. In one or more embodiments, such integrated circuits execute instructions that are stored on the circuit itself.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more embodiments, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

As used in this specification and any claims of this application, the terms "base station," "receiver," "computer," "server," "processor," and "memory" all refer to electronic or other technological devices. These terms exclude people or groups of people. For the purposes of the specification, the terms "display" or "displaying" means displaying on an electronic device.

As used herein, the phrase "at least one of" preceding a series of items, with the term "and" or "or" to separate any of the items, modifies the list as a whole, rather than each member of the list (i.e., each item). The phrase "at least one of" does not require the selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refers to only A, only B, or only C; any combination of A, B, and C; and/or at least one of each of A, B, and C.

The predicate words "configured to," "operable to," and "programmed to" do not imply any particular tangible or intangible modification of a subject, but, rather, are intended to be used interchangeably. In one or more embodiments, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration". Any embodiment described herein as "exemplary" or as an "example" is not necessarily to be construed as preferred or advantageous over other embodiments. Furthermore, to the extent that the term "include," "have," or the like is used in the description or the claims, such term is intended to be inclusive in a manner similar to the phrase "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f), unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) may be used generally to refer to both masculine and feminine pronouns. Headings and subheadings, if any, are used for convenience only and do not limit the subject disclosure.

What is claimed is:

1. An exercise mat comprising:

a first layer comprising:

a top surface and a bottom surface, and a plurality of interstices; and a second layer comprising:

a top surface and a bottom surface, and a plurality of protrusions extending from the top surface of the second layer, wherein the top surface of the second layer is connected to the bottom surface of the first layer, the plurality of protrusions contain a display element, and the plurality of protrusions correspond to the plurality of interstices such that, when the top surface of the second layer is connected to the bottom surface of the first layer, the plurality of protrusions are flush with the top surface of the first layer; and a third layer comprising:

a top surface, a bottom surface, a plurality of side surfaces, and a cavity defined at least in part by the plurality of side surfaces, and an electronic component within the cavity, wherein the top surface of the third layer is connected to the bottom surface of the second layer, and the electronic component is communicatively coupled to the display element.

2. The exercise mat of claim 1 wherein:

the plurality of interstices have a substantially polygonal shape; and the plurality of protrusions have a substantially polygonal shape.

3. The exercise mat of claim 1 wherein:

the plurality of interstices and the plurality of protrusions are substantially the same size; and the plurality of interstices and the plurality of protrusions comprise a plurality of zones, each zone having a different size of the plurality of protrusions.

4. The exercise mat of claim 1 wherein:

the first layer, the second layer, and the third layer are rollable from a first configuration to a second configuration.

5. The exercise mat of claim 4 wherein:

the first layer is made from a first material;

the second layer is made from a second material; and the third layer is made from a third material.

6. The exercise mat of claim 4 wherein:

the first layer further comprises:

a first end and a second end; and a magnetic closure on at least one of the first end and the second end that holds the exercise mat in the second configuration.

7. The exercise mat of claim 1 wherein:

the third layer further comprises:

a charging contact for coupling to a power source.

8. The exercise mat of claim 1 wherein:

the plurality of protrusions are configured to present a graphic based on a signal from the electronic component.

9. The exercise mat of claim 8 wherein:

the plurality of protrusions are configured to present subsequent graphics based on a plurality of signals from the electronic component corresponding to a cadence.

10. The exercise mat of claim 1 wherein:

the electronic component is communicatively coupled to an external device;

the electronic component receives a signal from the external device;

the electronic component generates a graphic based on the received signal; and the electronic component generates a signal based on the generated graphic; and the electronic component transmits the generated signal to the plurality of protrusions for displaying the generated graphic.

11. The exercise mat of claim 10 wherein:

the external device generates a second signal to a second external device for generating a second graphic; and the graphic of the exercise mat corresponds to the second graphic of the second external device.

12. An exercise mat comprising:

a first layer comprising:

a top surface and a bottom surface, and a plurality of interstices; and a second layer comprising:

a top surface and a bottom surface, and a plurality of protrusions extending from the top surface of the second layer, wherein the top surface of the second layer is connected to the bottom surface of the first layer, the plurality of protrusions contain a display element, and the plurality of protrusions correspond to the plurality of interstices such that, when the top surface of the second layer is connected to the bottom surface of the first layer, the plurality of protrusions are flush with the top surface of the first layer.

13. The exercise mat of claim 12 wherein:

the plurality of protrusions are configured to present a graphic based on a signal comprising data representing the graphic.

14. The exercise mat of claim 13 wherein:

the plurality of protrusions are configured to present subsequent graphics based on a plurality of signals comprising data representing the subsequent graphics and a cadence.

15. The exercise mat of claim 12 wherein:

a processor is communicatively coupled to an external device;

the processor receives a signal from the external device;

the processor generates a graphic based on the received signal; and the processor generates a signal based on the generated graphic; and the processor transmits the generated signal to the plurality of protrusions for displaying the generated graphic.

16. The exercise mat of claim 15 wherein:

the external device generates a second signal to a second external device for generating a second graphic; and the graphic of the exercise mat corresponds to the second graphic of the second external device.

17. An exercise mat comprising:

a first layer comprising:

a top surface and a bottom surface, and a plurality of interstices;

a second layer comprising:

a top surface, a bottom surface, and a plurality of protrusions extending from the top surface of the second layer, wherein the top surface of the second layer is connected to the bottom surface of the first layer, the plurality of protrusions comprising a display element, and the plurality of protrusions correspond to the plurality of interstices such that, when the top surface of the second layer is connected to the bottom surface of the first layer, the plurality of protrusions are flush with the top surface of the first layer; and a third layer comprising an electronic component, the electronic component comprising a processor and a memory storing machine-readable instructions that, when executed by the processor, cause the processor to perform operations comprising:

receiving a signal comprising a graphic; and displaying the graphic via the second layer, wherein the plurality of protrusions present the graphic based on the signal.

18. The exercise mat of claim 17 wherein the machine-readable instructions cause the processor to perform operations further comprising:

receiving an audio;

determining a cadence based on the audio;

generating subsequent graphics for display via the second layer;

generating subsequent signals based on the subsequent graphics; and transmitting the subsequent signals to the second layer, wherein the plurality of protrusions present the subsequent graphics based on the subsequent signals from the electronic component.

19. The exercise mat of claim 17 wherein the machine-readable instructions cause the processor to perform operations further comprising:

receiving a second signal from an external device;

generating a second graphic based on the second signal;

generating a third signal based on the second graphic; and transmitting the third signal to the plurality of protrusions for displaying the second graphic.

20. The exercise mat of claim 19 wherein:

the external device generates a fourth signal to a second external device for generating a third graphic; and the second graphic of the exercise mat corresponds to the third graphic of the second external device.

* * * * *